US009265292B2

(12) United States Patent
Smith et al.

(10) Patent No.: US 9,265,292 B2
(45) Date of Patent: Feb. 23, 2016

(54) EASY DONNING GARMENT

(75) Inventors: Aaron Drake Smith, Roswell, GA (US); Frances W. Mayfield, Marietta, GA (US); Theresa M. McCoy, Cumming, GA (US); Ruthlyn M. Reyes, Roswell, GA (US); Normand Gagnier, Cumming, GA (US); Dennis Yi-Der Lee, Cumming, GA (US)

(73) Assignee: Kimberly-Clark Worldwide, Inc., Neenan, WI (US)

( * ) Notice: Subject to any disclaimer, the term of this patent is extended or adjusted under 35 U.S.C. 154(b) by 2132 days.

(21) Appl. No.: 12/024,176

(22) Filed: Feb. 1, 2008

(65) Prior Publication Data

US 2009/0019616 A1 Jan. 22, 2009

Related U.S. Application Data

(63) Continuation-in-part of application No. 11/780,758, filed on Jul. 20, 2007, now Pat. No. 7,841,020.

(51) Int. Cl.

| | |
|---|---|
| ***A41D 15/00*** | (2006.01) |
| ***A41D 13/12*** | (2006.01) |
| ***A41D 13/02*** | (2006.01) |

(52) U.S. Cl.

CPC ..... *A41D 15/002* (2013.01); *A41D 13/02* (2013.01); *A41D 13/1209* (2013.01); *A41D 13/129* (2013.01); *A41D 2400/44* (2013.01)

(58) Field of Classification Search

CPC ... A41D 15/002; A41D 15/04; A41D 19/005; A41D 13/1209; A41D 13/02; A41D 2400/44; A41D 13/129

USPC ..... 2/114, 71, 72, 75, 80, 111, 125, 323, 2/269, 270, 79

See application file for complete search history.

(56) References Cited

U.S. PATENT DOCUMENTS

| | | | | |
|---|---|---|---|---|
| 57,950 | A * | 9/1866 | Moody | 2/217 |
| 222,262 | A * | 12/1879 | Felt | 2/269 |
| 237,096 | A | 2/1881 | Delmonte | |
| 280,167 | A | 6/1883 | Ford | |
| 461,434 | A * | 10/1891 | Henry | 2/269 |
| 560,683 | A * | 5/1896 | Bruckner | 2/227 |

(Continued)

FOREIGN PATENT DOCUMENTS

| | | |
|---|---|---|
| CA | 803714 | 1/1969 |
| DE | 040302713 | 4/2004 |

(Continued)

OTHER PUBLICATIONS

AATCC Test Method 127-1998, "Water Resistance: Hydrostatic Pressure Test," 1998, pp. 211-212.

(Continued)

*Primary Examiner* — Alissa L Hoey
(74) *Attorney, Agent, or Firm* — Dority & Manning, P.A.

(57) ABSTRACT

A protective garment configured to facilitate easy donning of the garment is described. The sleeves and legs are shorted and held in a donning configuration by releaseably affixing at least a portion of upper and lower segments of the interior surface of each limb. This allows the garment to be handled and donned by the wearer, without the wearer touching an exterior surface of the garment. A method of preparing a protective garment for donning and a method of donning such a garment is also disclosed.

11 Claims, 6 Drawing Sheets

(56) References Cited

U.S. PATENT DOCUMENTS

| | | | | | |
|---|---|---|---|---|---|
| 823,534 | A | * | 6/1906 | Hutchinson | 2/269 |
| 1,085,399 | A | | 1/1914 | Bauer | |
| 1,306,935 | A | * | 6/1919 | Walcoff | 2/228 |
| 1,593,027 | A | * | 7/1926 | Powell | 2/269 |
| 1,600,897 | A | | 9/1926 | Lesser | |
| 1,696,714 | A | * | 12/1928 | Heller | 2/79 |
| 1,840,888 | A | * | 1/1932 | Dooley | 2/75 |
| 2,153,068 | A | | 4/1939 | Arden | |
| 2,187,447 | A | | 1/1940 | Chait et al. | |
| 2,280,467 | A | | 4/1942 | Blanc | |
| 2,352,614 | A | * | 7/1944 | Brown | 2/269 |
| 2,524,448 | A | | 10/1950 | Kaplan | |
| 2,670,471 | A | * | 3/1954 | Kaufman | 2/80 |
| 2,675,554 | A | * | 4/1954 | Gertz | 2/80 |
| 2,705,326 | A | * | 4/1955 | Lahnstein et al. | 2/83 |
| 2,719,981 | A | | 10/1955 | Walter | |
| 2,777,130 | A | | 1/1957 | Keller | |
| 2,846,686 | A | | 8/1958 | Daniel | |
| 2,994,089 | A | * | 8/1961 | Ferguson, Jr. et al. | 2/81 |
| 3,082,764 | A | * | 3/1963 | Galanis | 128/881 |
| 3,276,944 | A | | 10/1966 | Levy | |
| 3,328,809 | A | | 7/1967 | Payane et al. | |
| 3,338,992 | A | | 8/1967 | Kinney | |
| 3,341,394 | A | | 9/1967 | Kinney | |
| 3,359,569 | A | | 12/1967 | Rotanz et al. | |
| 3,372,402 | A | * | 3/1968 | Kaufmann | 2/232 |
| 3,419,908 | A | | 1/1969 | Germani | |
| 3,496,572 | A | | 2/1970 | Herzig | |
| 3,502,538 | A | | 3/1970 | Petersen | |
| 3,502,763 | A | | 3/1970 | Hartmann | |
| 3,542,615 | A | | 11/1970 | Dobo et al. | |
| 3,625,206 | A | | 12/1971 | Charnley | |
| 3,692,618 | A | | 9/1972 | Dorschner et al. | |
| 3,774,240 | A | | 11/1973 | Johnson | |
| 3,812,539 | A | | 5/1974 | Muehlberg et al. | |
| 3,849,241 | A | | 11/1974 | Butin et al. | |
| 4,000,521 | A | | 1/1977 | Zoephel et al. | |
| 4,041,203 | A | | 8/1977 | Brock et al. | |
| 4,117,552 | A | | 10/1978 | Simpson | |
| 4,149,275 | A | | 4/1979 | Sanchez | |
| 4,200,938 | A | | 5/1980 | LeTourneau | |
| 4,214,320 | A | | 7/1980 | Belkin | |
| 4,340,563 | A | | 7/1982 | Appel et al. | |
| 4,374,888 | A | | 2/1983 | Bornslaeger | |
| 4,475,252 | A | | 10/1984 | Peyser et al. | |
| 4,523,335 | A | | 6/1985 | Scrivens | |
| 4,655,760 | A | | 4/1987 | Morman et al. | |
| 4,657,802 | A | | 4/1987 | Morman | |
| 4,705,171 | A | | 11/1987 | Eldridge | |
| 4,718,122 | A | * | 1/1988 | Steverson | 2/70 |
| 4,720,415 | A | | 1/1988 | Vander Wielen et al. | |
| 4,753,843 | A | | 6/1988 | Cook et al. | |
| 4,773,100 | A | | 9/1988 | Kuo | |
| 4,773,101 | A | | 9/1988 | Kapp et al. | |
| 4,781,966 | A | | 11/1988 | Taylor | |
| 4,783,854 | A | | 11/1988 | Björklund | |
| 4,789,699 | A | | 12/1988 | Kieffer et al. | |
| 4,941,209 | A | * | 7/1990 | George | 2/79 |
| 4,942,987 | A | | 7/1990 | Stackhouse | |
| 4,965,122 | A | | 10/1990 | Morman | |
| 4,981,747 | A | | 1/1991 | Morman | |
| 4,985,936 | A | * | 1/1991 | Jones | 2/269 |
| 5,033,115 | A | | 7/1991 | Bowling et al. | |
| 5,033,127 | A | * | 7/1991 | Schmeltz | 2/269 |
| 5,067,179 | A | | 11/1991 | Wormser | |
| 5,097,534 | A | | 3/1992 | Viemeister et al. | |
| 5,208,920 | A | | 5/1993 | Schaefer et al. | |
| 5,213,881 | A | | 5/1993 | Timmons et al. | |
| 5,226,992 | A | | 7/1993 | Morman | |
| 5,299,323 | A | * | 4/1994 | Schaefer et al. | 2/93 |
| 5,336,545 | A | | 8/1994 | Morman | |
| 5,401,446 | A | | 3/1995 | Tsai et al. | |
| 5,410,758 | A | | 5/1995 | Dupont et al. | |
| 5,487,189 | A | | 1/1996 | Bell | |
| 5,491,753 | A | | 2/1996 | Van Hout et al. | |
| 5,511,246 | A | | 4/1996 | Farkas et al. | |
| 5,535,453 | A | | 7/1996 | Howard | |
| 5,539,932 | A | | 7/1996 | Howard | |
| 5,575,010 | A | | 11/1996 | Chung | |
| 5,628,064 | A | * | 5/1997 | Chung | 2/70 |
| 5,770,529 | A | * | 6/1998 | Dennis et al. | 442/268 |
| 5,787,511 | A | | 8/1998 | Garside | |
| D402,439 | S | * | 12/1998 | Marks | D2/757 |
| 5,867,825 | A | | 2/1999 | Scheerer | |
| 5,960,473 | A | | 10/1999 | Tajima | |
| 6,029,274 | A | * | 2/2000 | Welchel et al. | 2/69 |
| 6,058,508 | A | * | 5/2000 | Brown Honeysuckle | 2/69 |
| 6,148,445 | A | | 11/2000 | Spruill | |
| 6,317,894 | B1 | | 11/2001 | Blechman | |
| 6,654,968 | B2 | * | 12/2003 | Braun et al. | 2/269 |
| 6,694,522 | B1 | * | 2/2004 | Neal | 2/114 |
| 6,817,033 | B2 | * | 11/2004 | Bailey | 2/69.5 |
| D534,334 | S | | 1/2007 | Davis | |
| 7,168,103 | B2 | | 1/2007 | Aldridge et al. | |
| 7,305,717 | B1 | * | 12/2007 | Brown | 2/114 |
| 7,841,020 | B2 | * | 11/2010 | Mayfield et al. | 2/69 |
| 7,971,272 | B2 | * | 7/2011 | Bailey et al. | 2/80 |
| 2003/0226196 | A1 | | 12/2003 | Grilliot | |
| 2006/0064797 | A1 | | 3/2006 | Pyeatt Rowe et al. | |
| 2006/0107437 | A1 | | 5/2006 | Griesbach, III | |
| 2006/0185065 | A1 | | 8/2006 | Allen | |
| 2006/0191054 | A1 | | 8/2006 | Noe | |
| 2006/0272070 | A1 | | 12/2006 | Hakkarainen et al. | |
| 2007/0266472 | A1 | * | 11/2007 | DuFaux | 2/80 |
| 2008/0127398 | A1 | * | 6/2008 | Ryan | 2/269 |
| 2009/0019622 | A1 | * | 1/2009 | Mayfield et al. | 2/455 |
| 2009/0235434 | A1 | * | 9/2009 | Ratcliffe | 2/269 |
| 2010/0175166 | A1 | * | 7/2010 | Bradt | 2/236 |
| 2010/0199399 | A1 | * | 8/2010 | Garza | 2/24 |
| 2010/0281601 | A1 | * | 11/2010 | Clarke et al. | 2/236 |
| 2010/0299802 | A1 | * | 12/2010 | Bailey et al. | 2/70 |

FOREIGN PATENT DOCUMENTS

| | | | | | |
|---|---|---|---|---|---|
| EP | 0136140 | A1 | | 4/1985 | |
| EP | 0280101 | A1 | | 8/1988 | |
| EP | 0507607 | A1 | | 10/1992 | |
| EP | 0507608 | A1 | | 10/1992 | |
| EP | 1068810 | A1 | | 1/2001 | |
| EP | 1563747 | A2 | | 8/2005 | |
| FR | 2329219 | A | | 7/1977 | |
| FR | 2601859 | A1 | | 1/1988 | |
| FR | 2644988 | A1 | * | 10/1990 | A41B 13/00 |
| FR | 2756710 | A1 | | 6/1998 | |
| GB | 160385 | | | 3/1921 | |
| GB | 883413 | | | 11/1961 | |
| GB | 952125 | | | 3/1964 | |
| GB | 1492553 | | | 11/1977 | |
| GB | 2155761 | | | 10/1985 | |
| GB | 2269085 | | | 2/1994 | |
| WO | WO 89/08994 | | | 10/1989 | |
| WO | WO 93/15621 | | | 8/1993 | |
| WO | WO 2005/065475 | | | 7/2005 | |
| WO | WO 2005/065476 | | | 7/2005 | |
| WO | WO 2006/038913 | | | 4/2006 | |

OTHER PUBLICATIONS

ASTM Designation: D737-96, "Standard Test Methods for Air Permeability of Textile Fabrics", Published Apr. 1996, pp. 207-211.

ASTM Designation: E 96-80, "Standard Test Methods for Water Vapor Transmission of Materials", Published Feb. 1981, pp. 87-96.

Federal Test Method Standard No. 191A, Method 5450, "Permeability to Air; Cloth; Calibrated Orifice Method", Jul. 1978.

Lawrence, K.D. et al., *NRL Report 5265*, "An Improved Device for the Formation of Superfine Thermoplastic Fibers", Feb. 1959.

Wente, V.A. et al., *NRL Report 4364*, "Manufacture of Super-Fine Organic Fibers", May 1954.

* cited by examiner

EASY DONNING GARMENT

CROSS REFERENCE TO RELATED APPLICATION

This application is a continuation-in-part of U.S. Ser. No. 11/780,758 entitled "Easy Donning Garment" to Frances W. Mayfield et al., filed Jul. 20, 2007, the entire disclosure of which is incorporated herein by reference.

BACKGROUND

There are many types of limited-use or disposable protective garments designed to provide barrier properties. One type of protective apparel is protective coveralls. For example, garments, such as coveralls, can be used to effectively seal off a wearer from a harmful environment in ways that open or cloak style garments (for example, drapes, gowns and the like) are unable to do. Accordingly, coveralls have many applications where isolation of a wearer is desirable. Such protective apparel keeps clothing clean and keeps dirt and other residue off of the wearer's skin. For a variety of reasons, it is undesirable for hazardous liquids and/or pathogens that may be carried by liquids to pass through protective apparel. It is also highly desirable to use protective apparel to isolate persons from dusts, powders, and other particulates that may be present in a work place or accident site. Conversely, in cleanroom, critical manufacturing, and surgical environments, the protective apparel protects the environment from dust and debris that may otherwise be carried into the environment by the wearer.

Cleanroom manufacturing environments require garments to separate workers from the article being worked upon. Sometimes this is due to environments where the environs could harm the worker, however, more often it is due to the desire to protect the item from debris or contaminants the worker may introduce. For example, in aseptic manufacturing, various components are sterile when introduced to the aseptic environment and are assembled in the aseptic environment such that the resultant assembled article need not be sterilized. Such a manufacturing process is often found within the manufacturing and packaging of certain pharmaceuticals. Similar critical environments are also found in other areas such as certain surgical environments.

Due to the critical, sterile character of such environments, stringent protocols regarding apparel and apparel donning are followed such that no contaminants, including things such as dead skin and natural bacteria which may be present on workers' skin, are not accidentally transferred to the product or patient that the environment is structured to protect. To prevent such contamination, workers will don head-to-toe coverage, including booties, gloves, and coveralls, to protect the environment. To ensure cleanliness, workers undergo extensive training regarding the donning of such garments. The worker is careful to don such garments without touching exterior surfaces of the garment while being careful that the garment does not touch the floor. If either occurs, the worker must obtain another, uncontaminated, garment to don.

Typically, careful donning of the garments begins with the worker reaching into the garment and shortening the legs and sleeves by shortening and grasping the sleeve and leg cuffs from the inside of the garment. While maintaining hold of the shortened sleeves and legs from inside the garment, the worker will then insert one leg at a time, being careful that the leg of the garment is not allowed to touch the floor. The worker then puts on the garment one arm at a time. During these donning steps, the worker must balance and contort their body to don the garment while not touching an external surface of the garment. Such donning takes training, practice, and a high degree of balance on the part of the wearer.

Various patent references describe protective garments adapted for donning. For example, one such garment is disclosed in U.S. Pat. No. 5,867,825 to Scheerer. That patent is directed to a garment package that is to facilitate donning of the garment with a garment that is pre-cuffed (the interior portion of garment near opening is exposed). The wearer inserts arms and legs and dons the pre-cuffed garment. Finally, the wearer must roll down the cuffs by grasping the externally-exposed interior surface of the cuff and rolling the cuff down.

Workers typically change their coveralls once a day, or every other day, depending on the requirements or standards of their respective industry. In some situations, workers may change their protective apparel even more frequently. After use, it can be quite costly to decontaminate, clean, and/or sterilize protective apparel after it has been used. Thus, it is important that protective apparel be inexpensive so as to be disposable. Generally speaking, protective coveralls are made from barrier materials/fabrics engineered to be relatively impervious to liquids and/or particulates as well as being low-linting. The cost of such materials as well as the coveralls' design and construction are important factors affecting cost. Desirably, all of these factors should be suited for the manufacture of protective garment, such as coveralls, at such low cost that it may be economical to discard the coveralls, if necessary, after only a single use.

DEFINITIONS

As used herein, the term "nonwoven-based material" or "nonwoven web" refers to a material or web that has a structure of individual fibers or filaments which are interlaid, but not in an identifiable repeating manner. Nonwoven webs have been, in the past, formed by a variety of processes known to those skilled in the art such as, for example, meltblowing, spunbonding and bonded carded web processes.

As used herein, the term "spunbonded web" refers to a web of small diameter fibers and/or filaments which are formed by extruding a molten thermoplastic material as filaments from a plurality of fine, usually circular, capillaries in a spinnerette with the diameter of the extruded filaments then being rapidly reduced, for example, by non-eductive or eductive fluid-drawing or other well known spunbonding mechanisms. The production of spunbonded nonwoven webs is illustrated in patents such as Appel, et al., U.S. Pat. No. 4,340,563; Dorschner et al., U.S. Pat. No. 3,692,618; Kinney, U.S. Pat. Nos. 3,338,992 and 3,341,394; Levy, U.S. Pat. No. 3,276,944; Peterson, U.S. Pat. No. 3,502,538; Hartman, U.S. Pat. No. 3,502,763; Dobo et al., U.S. Pat. No. 3,542,615; and Harmon, Canadian Patent No. 803,714.

As used herein, the term "meltblown fibers" means fibers formed by extruding a molten thermoplastic material through a plurality of fine, usually circular, die capillaries as molten threads or filaments into a high-velocity gas (e.g. air) stream which attenuates the filaments of molten thermoplastic material to reduce their diameters, which may be to microfiber diameter. Thereafter, the meltblown fibers are carried by the high-velocity gas stream and are deposited on a collecting surface to form a web of randomly disbursed meltblown fibers. The meltblown process is well-known and is described in various patents and publications, including NRL Report 4364, "Manufacture of Super-Fine Organic Fibers" by V. A. Wendt, E. L. Boone, and C. D. Fluharty; NRL Report 5265, "An Improved device for the Formation of Super-Fine Thermoplastic Fibers" by K. D. Lawrence, R. T. Lukas, and J. A. Young; and U.S. Pat. No. 3,849,241, issued Nov. 19, 1974, to Buntin, et al.

As used herein, the term "microfibers" means small diameter fibers having an average diameter not greater than about 100 microns, for example, having a diameter of from about 0.5 microns to about 50 microns, more specifically microfibers may also have an average diameter of from about 1 micron to about 20 microns. Microfibers having an average diameter of about 3 microns or less are commonly referred to as ultra-fine microfibers. A description of an exemplary process of making ultra-fine microfibers may be found in, for example, U.S. Pat. No. 5,213,881.

As used herein, the terms "sheet" and "sheet material" shall be interchangeable and in the absence of a word modifier, refer to a material that may be a film, nonwoven web, woven fabric or knit fabric.

As used herein, the term "machine direction" (hereinafter "MD") refers to the planar dimension of a material web, which is in the direction of a material parallel to its forward direction during processing. The term "cross-machine direction" (hereinafter "CD") refers to the planar dimension of a material, which is in the direction that is generally perpendicular to the machine direction.

As used herein, the term "liquid resistant" refers to material having a hydrostatic head of at least about 25 centimeters as determined in accordance with the standard hydrostatic pressure test AATCCTM No. 1998 with the following exceptions: (1) the samples are larger than usual and are mounted in a stretching frame that clamps onto the cross-machine direction ends of the sample, such that the samples may be tested under a variety of stretch conditions (e.g., 10%, 20%, 30%, 40% stretch); and (2) the samples are supported underneath by a wire mesh to prevent the sample from sagging under the weight of the column of water.

As used herein, the term "breathable" refers to material having a Frazier porosity of at least about 25 cubic feet per minute per square foot (cfm/ft$^2$). For example, the Frazier porosity of a breathable material may be from about 25 to more than 45 cfm/ft$^2$. The Frazier porosity is determined utilizing a Frazier Air Permeability Tester available from the Frazier Precision Instrument Company. The Frazier porosity is measured in accordance with Federal Test Method 5450, Standard No. 191A, except that the sample size is 8"×8" instead of 7"×7".

As used herein, the term "particle resistant" refers to a fabric having a useful level of resistance to penetration by particulates. Resistance to penetration by particulates may be measured by determining the air filter retention of dry particles and can be expressed as particle holdout efficiency. More specifically, particle hold-out efficiency refers to the efficiency of a material at preventing the passage of particles of a certain size range through the material. Particle holdout efficiency may be measured by determining the air filter retention of dry particles utilizing tests such as, for example, IBR Test Method No. E-217, Revision G (1/15/91) performed by InterBasic Resources, Inc. of Grass Lake, Mich. Generally speaking, high particle holdout efficiency is desirable for barrier materials/fabrics. Desirably, a particle resistant material should have a particle holdout efficiency of at least about 40 percent for particles having a diameter greater than about 0.1 micron. LMS Labs are used to substantiate claims made in catalog. The apparel catalog references air permeability ASTM D737 and Moisture Vapor Transport Rate ASTM E96 as methods related to comfort properties.

As used herein, the term "elastomeric" refers to a material or composite which can be extended or elongated by at least 25% of its relaxed length and which will recover, upon release of the applied force, at least 10% of its elongation. It is generally preferred that the elastomeric material or composite be capable of being elongated by at least 100%, recover at least 50% of its elongation. An elastomeric material is thus stretchable and "stretchable", "elastomeric", and "extensible" may be used interchangeably.

As used herein, the terms "elastic" or "elasticized" means that property of a material or composite by virtue of which it tends to recover towards its original size and shape after removal of a force causing a deformation.

As used herein, the term "necked-bonded" laminate refers to a composite material having an elastic member that is bonded to a non-elastic member while the non-elastomeric member is extended in the machine direction creating a necked material that is elastic in the transverse or cross-direction. Examples of necked-bonded laminates are disclosed in U.S. Pat. Nos. 4,965,122; 4,981,747; 5,226,992; and 5,336,545.

As used herein, the term "stretch-bonded" laminate refers to a composite material having at least two layers in which one layer is a gatherable layer and the other layer is an elastic layer. The layers are joined together when the elastic layer is in an extended condition so that upon relaxing the layers, the gatherable layer is gathered. For example, one elastic member can be bonded to another member while the elastic member is extended at least about 25% of its relaxed length. Such a multiplayer composite elastic material may be stretched until the non-elastic layer is fully extended. Examples of stretch-bonded laminates are disclosed, for example, in U.S. Pat. Nos. 4,720,415, 4,789,699, 4,781,966, 4,657,802, and 4,655,760.

As used herein, the term "disposable" is not limited to single use articles but also refers to articles that are so relatively inexpensive to the consumer that they can be discarded if they become soiled or otherwise unusable after only one or a few uses.

As used herein, the term "garment" refers to protective garments and/or shields including for example, but not limited to surgical gowns, patient drapes, work suits, coveralls, jumpers, aprons, and the like.

As used herein, the term "coveralls" refers to a relatively loose fitting, one-piece, protective garment that can be worn over other articles of clothing and protects substantial areas of a wearer's body, typically, from the neck region over the trunk of the body and out to the ends of extremities, such as a wearer's wrists and ankles, which sometimes may include the hands and feet. In some embodiment, the garment may include an attached head cover, such as a hood, or integrated gloves and socks, boots, or other footwear.

As used herein, the term "polymer" generally includes, but is not limited to, homopolymers, copolymers, such as, for example, block, graft, random and alternating copolymers, terpolymers, etc. and blends and modifications thereof. Furthermore, unless otherwise specifically limited, the term "polymer" shall include all possible geometrical configurations of the material. These configurations include, but are not limited to, isotactic, syndiotactic and random symmetries.

As used herein, the term "consisting essentially of" does not exclude the presence of additional materials which do not significantly affect the desired characteristics of a given composition or product. Exemplary materials of this sort would include, without limitation, pigments, antioxidants, stabilizers, surfactants, waxes, flow promoters, particulates or materials added to enhance ability to process of a composition.

As used herein, the term "couple" or "affix" includes, but is not limited to, joining, connecting, fastening, linking, or associating two things integrally or interstitially together. As used herein, the term "releaseably affix(ed)" refers to two or more things that are stably coupled together and are at the same time capable of being manipulated to uncouple the things from each another.

As used herein, the term "configure" or "configuration" means to design, arrange, set up, or shape with a view to specific applications or uses. For example: a military vehicle that was configured for rough terrain; configured the computer by setting the system's parameters.

As used herein, the term "substantially" refers to something which is done to a great extent or degree; for example, "substantially covered" means that a thing is at least 95% covered.

As used herein, the term "alignment" refers to the spatial property possessed by an arrangement or position of things in a straight line or in parallel lines.

As used herein, the terms "orientation" or "position" used interchangeably herein refer to the spatial property of a place where or way in which something is situated; for example, "the position of the hands on the clock."

SUMMARY OF THE INVENTION

In light of the problems discussed above, a need exists for an inexpensive protective garment that allows for a wearer to easily don the garment without touching the exterior of the garment and simultaneously preventing the garment from touching any other surface. In accordance with the present disclosure, the problem of garment donning is eased by a protective garment that is provided to the wearer in a donning configuration where the legs and sleeves of the garment are releasably affixed in a shortened orientation to aid in donning.

The present disclosure is directed to a sterile protective garment having a body portion, left and right legs extending from the body portion, and left and right sleeves extending from the body portion. Additionally, each sleeve and each leg have an opening that is distal to the body portion, an upper segment proximate the body portion, and a lower segment distal the body portion. Further, each leg includes an extended total leg length measured from the body portion to the distal opening and each sleeve includes an extended total sleeve length measured from the body portion to the distal opening. Finally, the garment has a donning configuration in which at least a portion of the upper segments are releaseably affixed to at least a portion of the lower segments for each of the sleeves and legs. Thus, in such a donning configuration, the legs and sleeves of the garment are held in a shortened orientation. In some embodiments, the shortened length of the sleeves or legs may be approximately two-thirds, or less, of the full or total extended length of the sleeves or legs, respectively.

An optional feature of the garment is that the portions of the upper and lower segments of the sleeves or legs that are releaseably affixed in the donning configuration may include a seam inside the garment. Another optional feature of the garment is that the legs and sleeves may be releaseably affixed in the donning configuration with the use of at least one fastener limited to the interior surface of the legs and sleeves. More specifically, in certain embodiments, the garment may include at least one sleeve fastener limited to an interior surface of each sleeve and at least one leg fastener limited to an interior surface of each leg. Further, it is contemplated that such fasteners may be used along with a cooperative fastener to releaseably affix the sleeves or legs in the donning configuration.

The present disclosure is also directed to a protective garment with a body portion, arms and legs extending from the body portion, and fasteners positioned on the interior surface of each limb at a point between the body portion and midway down the limb. The garment has a donning configuration in which the fastener within each limb is releaseably affixed to the interior surface of the limb at a point further away from the body portion than the fastener. In some embodiments, such fasteners may be positioned on a seam within the limb.

In optional embodiments of the garment, each sleeve and each leg may include a cooperative fastener limited to the interior surface of each limb between the distal opening of the particular limb and a point 50 percent of the limb length distal from the body portion. The fasteners within each limb may then be releaseably affixed to the cooperative fasteners within each corresponding sleeve and leg, to hold the garment in its donning configuration. More specifically, in certain embodiments, the donning configuration includes coupling the upper segment of each sleeve to the lower segment of each sleeve by the sleeve's respective sleeve fastener and coupling the upper segment of each leg to the lower segment of each leg by the leg's respective leg fastener. In some embodiments, each cooperative fastener may be positioned on the interior surface between a point 50 percent distal from the body portion and a point 80 percent distal from the body portion. In further embodiments, the fastener may be positioned on the interior surface between a point 5 percent distal from the body portion and a point 30 percent distal from the body portion.

The present disclosure is also directed to a method of preparing such a protective garment for donning. The method includes the steps of first providing such a protective garment and then shortening the sleeves and legs by releaseably affixing a portion of the upper segment to a portion of the lower segment for each of the sleeves and legs. In some embodiments of the method, the garment may additionally be folded in such a way that an interior surface of the garment is available for the wearer to grasp. Some embodiments of the method includes the further steps of placing the folded garment in a bag, sealing the bag to form a garment package, and sterilizing the garment package. Additionally, such a folded garment package may be vacuum-packaged.

Finally, the present disclosure is also directed to a method of donning a sterile garment that has been prepared into a donning configuration, as discussed above. The donning method includes the step of first grasping the folded garment by the interior surface without touching the exterior surface of the garment and without allowing any part of the garment to touch the floor. The wearer inserts a foot and leg into the appropriate shortened leg and pushes their foot toward the leg opening, such that the lower segment of the leg is released from the upper segment. This is then repeated with the other leg. With both of their legs in the legs of the garment, the wearer pulls the body portion of the garment over their torso and thus extends the legs of the garment to the full length of their legs. Next, the wearer inserts a hand and arm into the appropriate sleeve of the garment and pushes their hand toward the sleeve opening such that the lower segment of the sleeve releases from upper segment. This is then repeated for their other arm. Finally, the wearer fully extends the sleeves of the garment to the full length of their arms and closes the garment.

DETAILED DESCRIPTION

The present invention pertains to a limited-use protective garment having a design that allows the garment to be configured into a donning configuration to facilitate easy donning of the garment. Such garments are of particular interest to work areas and industries such as, for example, healthcare, home improvement do-it-yourself, chemical, industrial, sanitation, cleanrooms, and other similar applications.

Figure 1:
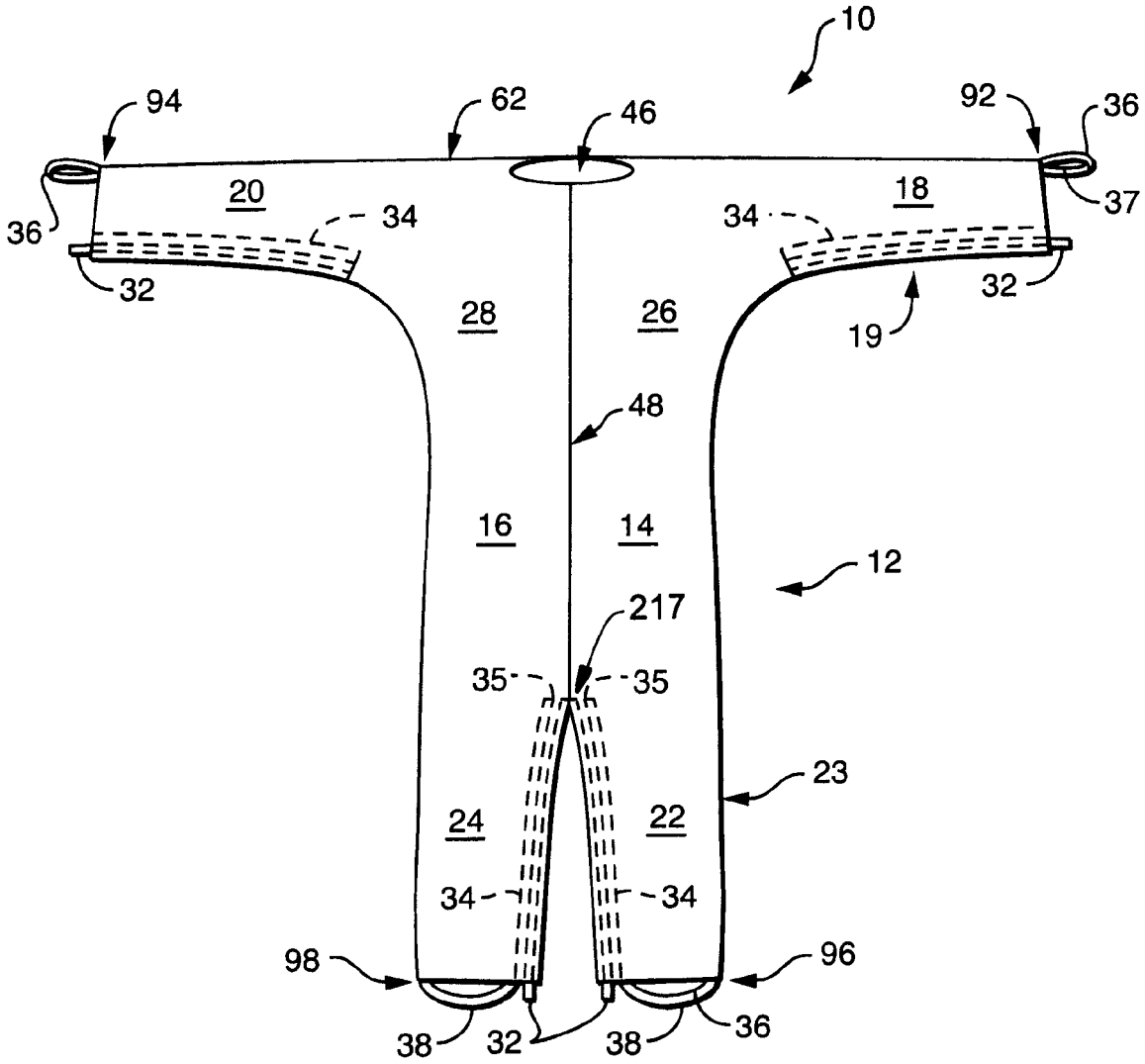
FIG. 1 illustrates a front view of an exemplary protective garment according to the present disclosure.
Figure 4:
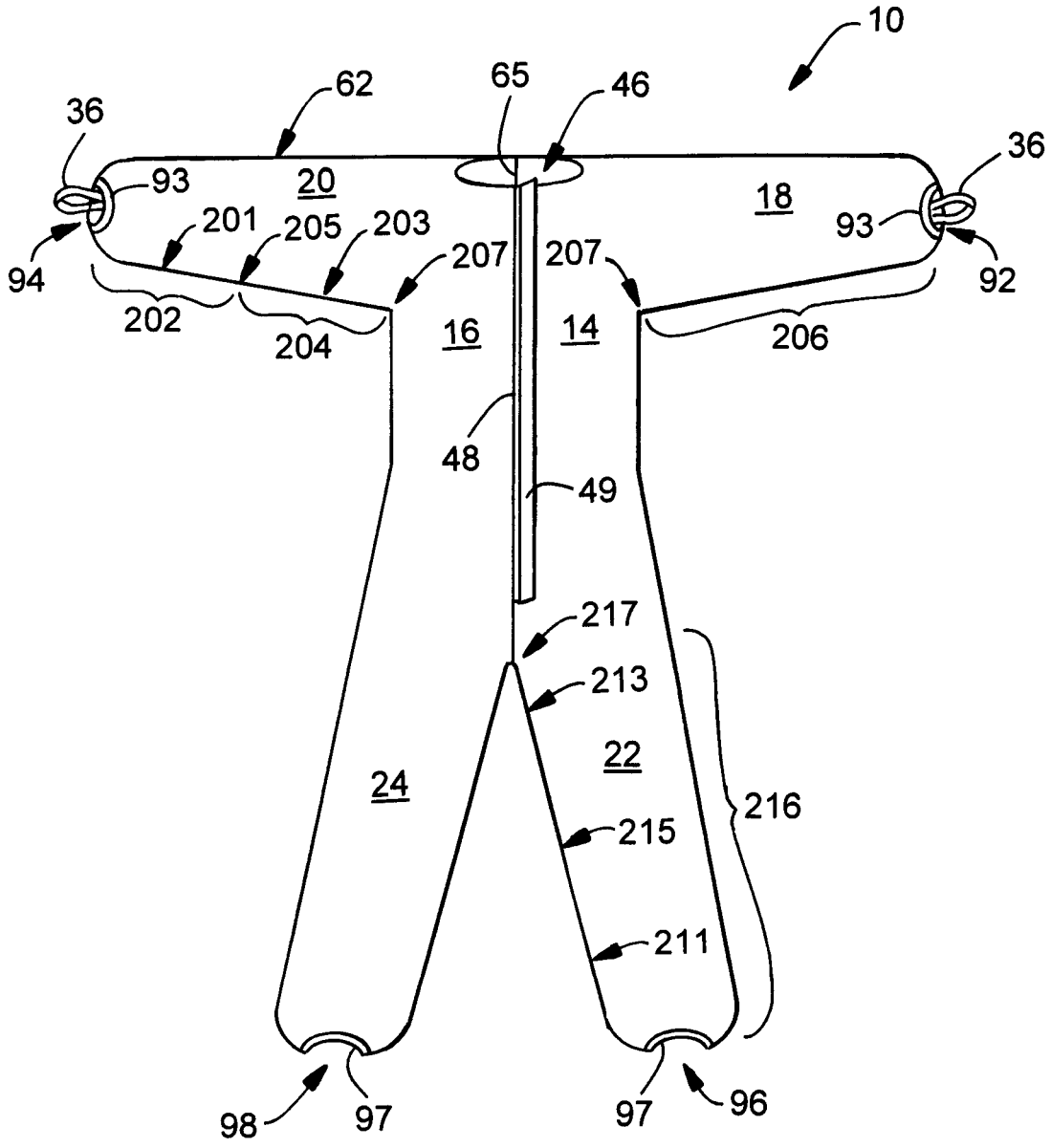
FIG. 4 illustrates a front view of an exemplary protective garment according to the present disclosure.

In part, FIGS. 1 and 4 illustrate the type of typical protective garment 10 that is contemplated by the present disclosure. A front view 12 of a garment 10 is shown in FIG. 1. The protective garment 10 includes a body portion made up of a left body panel 14 and a right body panel 16. It is desirable that each body panel 14, 16 is formed from a seamless sheet of material. The right body panel 16 is substantially a mirror image of the left body panel 14. The protective garment 10 includes left and right sleeves 18, 20 as well as left and right legs 22, 24, each of which extends from the body portion 14, 16 of the garment 10. A neck opening 46 is visible at the top of the garment 10. As shown in FIGS. 1 and 4, a closure means 48 extends from the neck opening 46 toward the crotch 217 of the garment 10.

The manufacture of such garments 10 may be in accordance with known automated, semi-automated, or hand assembly procedures. It is desired that the protective garment 10 contains the fewest practical number of panels, portions or sections in order to reduce the number of seams in the garment for better barrier properties and to simplify the manufacturing steps. However, it is contemplated that the protective garment 10 may contain sections, panels, or portions of barrier fabrics that may have different degrees of strength to customize the coverall for a particular application. For example, the sleeve portions 18, 20 or other portions (e.g., leg portions, shoulder portions or back portions of the coveralls) may include double layers of barrier fabrics with very high levels of strength and toughness. Examples of the type of garments 10 contemplated may be found in U.S. Pat. No. 5,487,189 to Bell, which is herein incorporated by reference, and in those garments available from Kimberly-Clark Corporation (Roswell, Ga.) sold under the KLEENGUARD® brand.

Figure 2:
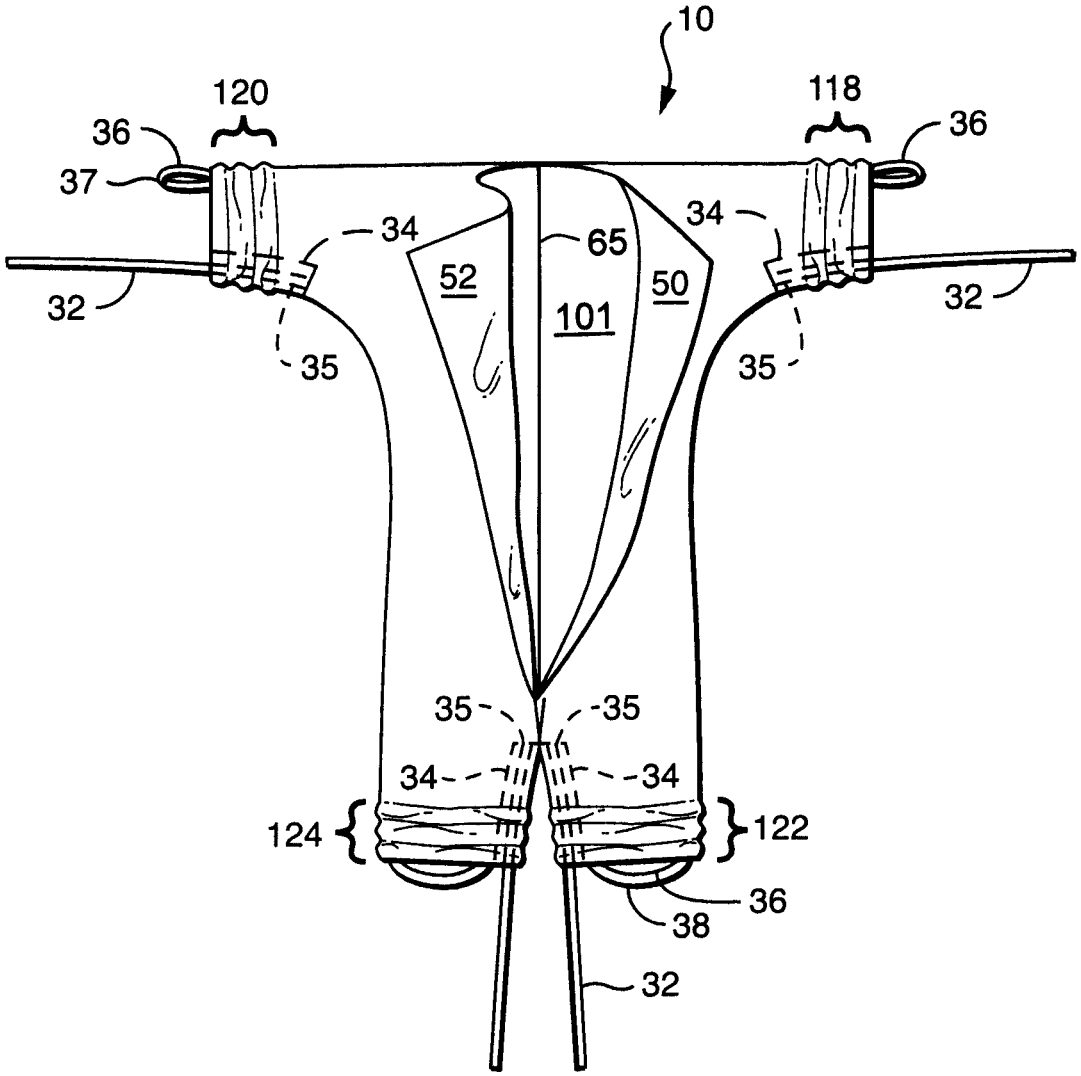
FIG. 2 illustrates a donning configuration of the protective garment of FIG. 1.
Figure 3:
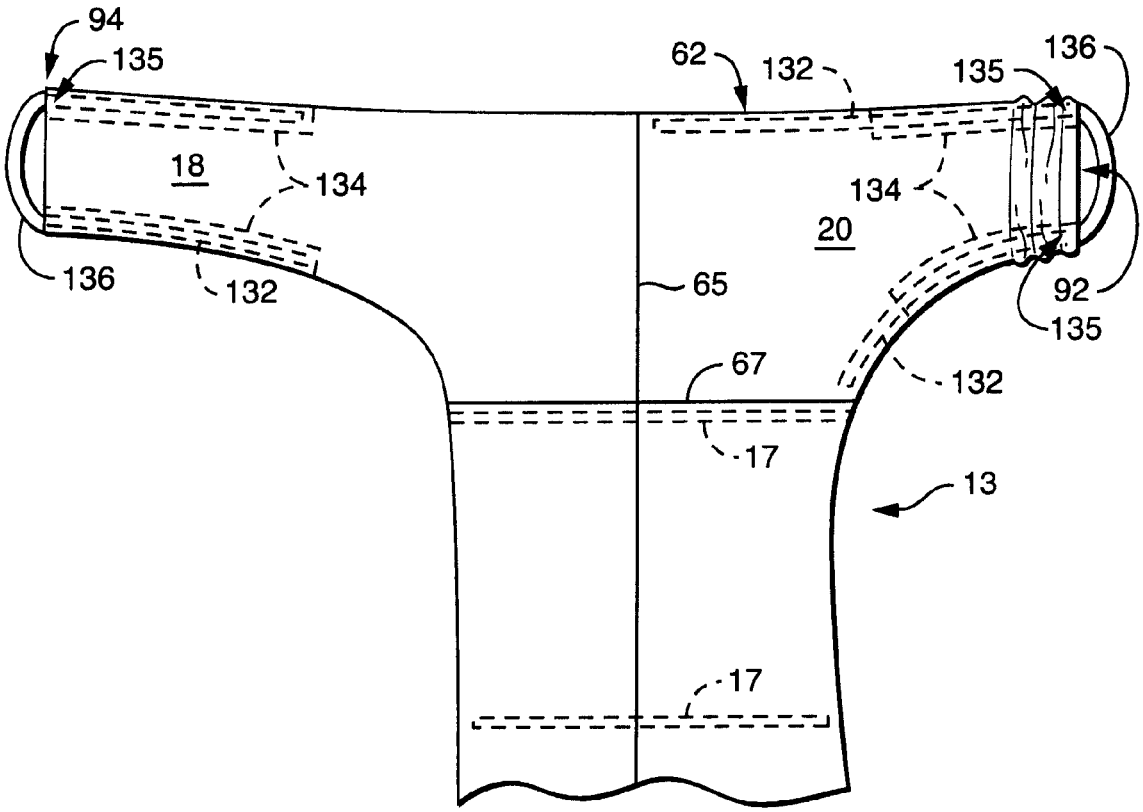
FIG. 3 is a rear partial view of upper portion of an exemplary protective garment according to the present disclosure and illustrates one sleeve in a foreshortened donning configuration.

Desirably, the left sleeve 18 may be an integral part of the left body panel 14 (i.e., the left body panel 14 cut to form a left sleeve 18). It is contemplated that the left sleeve 18 may be a separate piece of material that may be joined to the upper left body panel 26 by a seam (not shown). In the same way, it is desirable that the right sleeve 20 may be an integral part of the right body panel 16 (i.e., the right body panel 16 cut to form a right sleeve 20). It is contemplated that the right sleeve 20 may be a separate piece of material that may be joined to the upper right body panel 28 by a seam (not shown). A closure means 48 joins the left body panel 14 to the right body panel 16 on the front 10 of the garment 10. As shown in FIGS. 2 and 3, a vertical back seam 65 joins the body panels 14, 16 to each other on the back of the garment 10. The sleeves 18, 20 are desirably an integral part of the body portions 14, 16 and are formed with a seam 241 along the underside of the sleeve 18, 20 (see FIG. 6). Additionally, a horizontal back seam 67 joins a front portion of the upper body panels 26, 28 that extend over the shoulder 62 and to another portion of the body panels 14, 16 that extend around the sides of the garment 10 to the back side 13.

In the garment 10 illustrated in FIGS. 1 to 4, the sleeves 18, 20 are shown as extending outward from the body 14, 16 substantially parallel with the shoulder portions 62. However, other designs are possible. For example, the sleeves may be designed to extend upward from the general plane of the shoulder portions 62.

Desirably, the legs 22, 24 are formed in a way similar to the formation of the sleeves 18, 20. Desirably, the left leg 22 may be an integral part of the left body panel 14 (i.e., the left body panel 14 cut to form a left leg 22). It is contemplated that the left leg 22 may be a separate piece of material that may be joined to the left body panel 14 by a seam (not shown). In the same way, it is desirable that the right leg 24 may be an integral part of the right body panel 16 (i.e., the right body panel 16 cut to form a right leg 24). It is contemplated that the right leg 24 may be a separate piece of material that may be joined to the right body panel 16 by a seam (not shown).

Desirably, the left body panel 14 and the right body panel 16 are constructed such that the left and right upper sections 26, 28 and the left and right leg sections 22, 24 of the garment 10 corresponding to the left and right body panels 14, 16 are each made from single, or integral, pieces of material. Although less desirable, it is contemplated that seams (not shown) may be used to join the upper sections 26, 28 to the leg sections 22, 24, to join the sleeves 18, 20 to the upper sections 26, 28, or to join combinations thereof.

Figure 6:
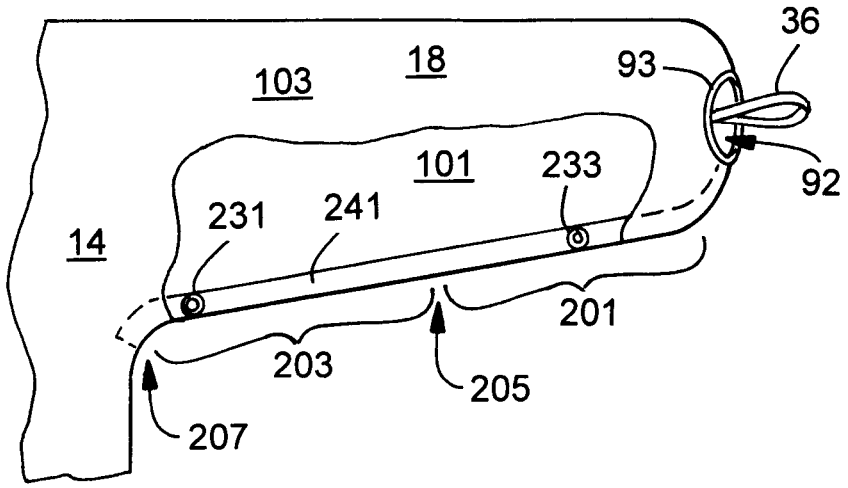
FIG. 6 is a perspective view, with parts broken away, illustrating a sleeve of a protective garment according to the present disclosure.

The seams used to form the garment 10 may be any type of seam that are appropriate in forming such garments. Such seams must be appropriate for the materials used in forming the garment 10, the strength required, and the level of security and protection that is desired. Typical seams used for such garments 10 include serged, sewn, bound, taped, welded, and heat sealed seams. Bound seams 241 (as shown in FIG. 6) are often used in garments 10 as it uses a binding that reinforces the serged seam for strength and tear resistance as well as covers the raw edges of the materials being joined, to further reduce the possibility of introducing free fibers into the environments in which such garments 10 are to be used.

As shown in FIGS. 1, 2 and 4, the sleeves 18, 20 include wrist openings 92, 94 at the distal ends of the sleeves 18, 20. Each of the sleeves 18, 20 may include a donning loop 36 associated with the opening. Similarly, each of the legs 22, 24 may include a donning loop 36 associated with the ankle openings 96, 98 at the distal end of each of the legs 22, 24, such as shown in FIGS. 1 and 2. For the particular garment 10 illustrated in FIGS. 1 and 2, the donning loop 36 associated with the wrists 92, 94 are thumb loops 37, while the donning loops 36 associated with the ankles 96, 98 are stirrups 38.

One solution for facilitating easy donning of such a garment 10 is illustrated in FIGS. 1 to 3 and includes the use of foreshortening structures to place the garment 10 in a donning configuration. As shown in FIGS. 1 to 3, the garment 10 additionally includes a foreshortening structure present on a portion of the interior surface 101 of the garment 10 on each of the sleeves 18, 20 and legs 22, 24. This foreshortening structure is a combination of an anchor strip 32 within a tubular sheath 34. The anchor strip 32 is anchored at one end of the tubular sheath 34, which allows the manufacturer to foreshorten the sleeves 18, 20 and legs 22, 24, such as shown in FIG. 2, prior to providing the garment 10 to the end user.

For the garment 10 illustrated in FIGS. 1 and 2, there is a single sheath 34 present on the interior surface 101 of each of the sleeves 18, 20 and for each of the legs 22, 24. The sheaths 34 present within the sleeves 18, 20 extend above the elbow 19 of the garment 10 and the anchor strip 32 is anchored at an anchor point 35 at the end of the sheath 34, within the sleeves 18, 20. The manufacturer configures the garment 10 in the foreshortened configuration of FIG. 2 by grasping the anchor strip 32 and pushing the sleeve 18 or 20 back towards the upper body portions 26 or 28 of the garment 10. This produces a foreshortened, or gathered, sleeve portions 118, 120 with a length of anchor strip 32 extending from the wrist openings 92, 94.

Similarly, the sheaths 34 present within the legs 22, 24 extend above the knee 23 of the garment 10 and the anchor strip 32 is anchored at an anchor point 35 at the end of the sheath 34, within the sleeves 18, 20. The manufacturer configures the garment 10 in the foreshortened configuration of FIG. 2 by grasping the anchor strip 32 and pushing the leg 22 or 24 upwards towards the body portions 14 or 16 of the garment 10. This produces a foreshortened, or gathered, leg portions 122, 124 with a length of anchor strip 32 extending from the ankle openings 96, 98.

The anchor points 35 may be any bonding means, attachment means, or structure that holds the anchor strip 32 in place such that the limbs of the garment 10 may be foreshortened (gathered) to facilitate easy donning. For example, the anchor points 35 may be an adhesive that attaches the end of the strip 32 to the sheath 34. Alternatively, the strip 32 may be physically stitched to the sheath 34 at the anchor point 35. Instead of an adhesive or stitch, or possibly in addition to such, the strip 32 may be attached to the sheath 34 by an ultrasonic bond.

The sheath 34 and anchor strip 32 are constructed to cooperate to allow the limbs of the garment 10 to be foreshortened, keep the garment 10 in such a donning configuration prior to donning, and allow the wearer to re-lengthen the sleeves 18, 20 and legs 22, 24 while the garment 10 is being donned. To that end, the sheath 34 and anchor strip 32 are constructed with cooperative dimensions (i.e., compatible relative cross-sectional areas) such that the sheath 34 can pass along the anchor strip 32, but not pass so easily that the garment 10 cannot be held in the donning configuration prior to donning. To ensure elimination of the possibility of linting, all of seams of the sheath 34, anchor strip 32, and the garment 10 may be bound, or raw edges of the materials used may be otherwise encased. Finally, the sheaths 34 may be tubular structures that are attached to the interior surface 101 of the garment 10 or they may instead be extensions of the edge of the garment material, at the garment seams, which is pulled over back upon itself to form the sheath 34.

While the sheaths 34 and anchor strips 32 of FIGS. 1 and 2 are shown extending above the elbows 19 of the sleeves 18, 20 and above the knees 23 of the legs 22, 24, other configurations are considered. The lengths of the sheaths 34 and anchor strips 32 may be longer or shorter than illustrated. The anchor strips 32 may be shorter than the sheaths 34 such that when the garment 10 is donned, the anchor strips 32 will be pulled within the sheath 34 as the wearer extends their arms and legs within the garment 10. This may be accomplished by using a shorter anchor strip 34, or by merely cutting the anchor strip 32 to a shorter length after the sleeves 18, 20 and legs 22, 24 have been foreshortened in preparing the garment 10 for donning.

FIG. 3 illustrates a partial rear view 13 of another exemplary protective garment 10, similar to the garment 10 of FIG. 1. The garment 10 of FIG. 3 has the same basic structure of the garment 10 of FIGS. 1 and 2. However, the garment 10 of FIG. 3 utilizes a different foreshortening structure associated with its wrist openings 92, 94. The protective garment 10, in FIG. 3, illustrates left and right sleeves 18, 20 in reversed position of the rear view 13 of the garment 10.

Instead of being anchored at a point 35 at the end of the sheath 34 within the interior of the garment 10, as illustrated in FIGS. 1 and 2, the anchor strip 132 may be anchored at a point 135 of the sheath 134 near the wrist or ankle openings, as illustrated in FIG. 3. In this orientation, the sleeves 18, 20 are foreshortened by pulling the anchor strip 132 within the interior of the garment 10 to pull the wrists 92, 94 toward the upper body panels 26, 28 of the garment 10.

Additionally, the embodiment of FIG. 3 also illustrates the possibility that the donning loop 136 may be a portion of an anchor strip 132. As shown in FIG. 3, a single anchor strip 132 extends though a pair of sheaths 134 and across the wrist openings 92, 94. The anchor strip 132 is anchored at a pair of anchor points 135 within the wrist openings 92, 94 of the sleeves 18, 20. Such a donning loop 136 and sheaths 134 could also be used for the donning loop 36 at the ankle openings 96, 98 at the ends of the legs 22, 24 (not shown).

The garments 10 illustrated in FIGS. 1 to 3 all include individual sheaths 34, 134 associated with each of the sleeve and leg openings. Alternatively, sheaths 34 may be shared by more than one of the openings of the garment 10. For example, a single sheath 34 may extend from the left sleeve opening 92, across the interior surface 101 of the back of the garment 10, and extend to the right sleeve opening 94. In such an exemplary embodiment, a single anchor strip 32 may be used, with a shared anchor point 35 in the center of the garment 10. Similarly, a single sheath 34 may be used to extend along the seam that extends from the left leg opening 96, up to the crotch 217 of the garment 10, and down to the right leg opening 98.

One skilled in the art would be able to see how various design and component combinations of the sheaths 34, 134, anchor strips 32, 132, donning loops 36, 136, and anchor points 35, 135 could be configured to produce variations of the inventive foreshortening structures. Such foreshortening structures provide the garment 10 with the ability to form a foreshortened donning configuration that facilitates easy donning of the garment.

Such a garment 10 may be packaged by any means and/or method that allows for the wearer to easily access the garment 10 for donning, while ensuring that the wearer does not touch an exterior surface 103 of the garment 10. One exemplary method of preparing the garment 10 for donning may include the first step of first foreshortening the sleeves 18, 20 and legs 22, 24 of the garment 10. As discussed above for the garment 10 illustrated in FIGS. 1 and 2, the manufacturer would push the openings 92, 94, 86, 98 of the limbs toward the body portions 26, 28, 14, 26 of the garment, while holding on to the anchor strip 32. A garment 10 in such a resultant donning configuration is illustrated in FIG. 2, which shows the gathered foreshortened sleeves 118, 120 and gathered foreshortened legs 122, 124.

Next, with the front side 12 of the garment 10 laying against a table, the gathered sleeves 118, 120 may then be folded toward the back side 13 of the garment. Similarly, the gathered legs 122, 124 may then be folded up toward the back side 13 of the garment 10, on top of the folded gathered sleeves 118, 120. Finally, the partially folded garment 10 may be flipped over such that the closure means 48 is facing upwards. The closure means 48 may be opened and the left and right opening flaps 50, 52 may be pulled open and around to the back 13 of the partially folded garment 10 such that only the interior surface 101 of the garment 10 is exposed on the outside of the folded garment.

This method of folding of the garment 10 is only one potential method of folding the garment 10. Other methods that foreshortened the sleeves 118, 120 and the legs 122, 124 and fold the garment 10 such that the interior surface 101 is made available to the wearer during subsequent unfolding and donning are also contemplated. One skilled in the art would see how a different order of folding steps, numbers of folds, desired final folded dimensions, and other such considerations, may contribute to different methods of folding up the garment 10.

Additionally, it may additionally be desirable to tuck the donning loops 36 into the wrist openings 92, 94 of the gathered sleeves 118, 120 and the ankle openings 96, 98 of the gathered legs 122, 124 such that the donning loops 36 are available on the inside of the garment 10 when the wearer later dons such a garment 10. It may also be desirable to tuck the anchor strips 32, 132 inside the gathered sleeve 118, 120 and gathered legs 122, 124 such that the wearer may be able to grasp them for greater control of the garment 10 limbs while donning the garment 10. Finally, such garments 10 are typically laundered and dried to remove any excessive particulates that may be present from the garment manufacturing process. This step would likely need to occur before the folding steps.

Once folded, the garment 10 may be packaged in any method as known to package such garments 10 to form a protective garment package to be delivered to the wearer. Typically, the folded garment 10 may be placed in a bag and the bag sealed to form a garment package. It may be desired that the garment package be sterilized by any sterilization as is known for such products. Additionally, it may be desirable that the air within the bag be removed during packaging, such that the garment is vacuum-packed, prior to such sterilization.

The garment 10 is configured such that the wearer of the garment may easily don the garment 10 without touching an exterior surface 103 of the garment and without letting any portion of the garment touch the floor. The wearer first grasps the interior surface 101 of the folded garment in such a way as to allow gravity to unfold the garment 10 into the donning configuration, such as illustrated in FIG. 2. The wearer then inserts one of their feet into the appropriate leg (22 or 24) of the garment 10, making sure that the foot passes through the leg opening (96 or 98) and engages the corresponding donning loop 36. This is then repeated for the wearer's other leg. As the wearer pulls up on the body portions 14, 16 of the garment 10, the gathered legs 122, 124 of the garment 10 will lengthen to length of the wearer's legs and provide the wearer with the appropriate leg fit.

Next, the wearer inserts one of their arms into the appropriate sleeve (18 or 20) of the garment 10, making sure that that their hand engages the corresponding donning loop 36. The donning loop 36 may be engaged with the hand, the thumb, and/or finger. This is then repeated for the wearer's other arm. As the wearer extends their arms into the sleeves 18, 20 and pulls the garment shoulders 62 over their own shoulders, the gathered sleeves 118, 120 will lengthen to the length of the wearer's arms and provide the wearer with the appropriate arm fit. The wearer then completes the donning of the garment 10 by closing the closing means 48.

In some embodiments, where the anchor strip 32 is designed to extend out of the sleeve and leg openings 92, 94, 96, 98 once the garment 10 is donned, the anchor strip 32 may provide an additional advantage in doffing the garment. When the wearer wishes to doff such a garment 10, he or she may grasp the exposed anchor strip 32 with a free hand and pull their hand or foot through the associated garment opening. Such a feature may be helpful in situations in which the wearer does not wish to touch the exterior surface 103 of the garment 10 after it has been worn.

Another solution that facilitates easy donning of such a sterile garment 10 by orienting the garment 10 in a donning configuration is illustrated in FIGS. 4 to 8B. This second solution puts the garment 10 in a donning configuration where the legs and sleeves are releaseably affixed in a shortened orientation to aid in donning. More specifically, a portion of the interior surface of each limb is releaseably affixed to another portion of the interior surface of that same limb. Again, the manufacturer shortens the garment 10 in the donning configuration shown in FIG. 5, prior to providing the garment 10 to the end user; the end user is thus presented with a garment 10 ready to don in its easy donning configuration.

In this embodiment of the garment 10, each of the sleeves 18, 20 has a lower sleeve segment 201 and an upper sleeve segment 203. The lower sleeve segment 201 is a part of the sleeve 18, 20 distal to the body portions 14, 16 and proximate to the sleeve openings 92, 94. The upper sleeve segment 203 is a part of the sleeve 18, 20 proximate to the body portions 14, 16 and distal to the sleeve openings 92, 94. Together, the segment lengths 202, 204 of the lower sleeve segment 201 and the upper sleeve segment 203 account for the total length 206 of the sleeve. As a reference point, each sleeve 18, 20 has a sleeve midpoint 205 that is located at the point along each sleeve length 206, approximately equidistant from the sleeve opening 92, 94 and the underarm 207 of the garment 10. The underarm 207 being where each sleeve 18, 20 meets the body portions 14, 16 of the garment 10. The lower and upper sleeve segments 201, 203 may be equal in length, such that the lower sleeve segment 201 would be the portion of the sleeve 18, 20 that lies below the sleeve midpoint 205 and the upper sleeve segment 203 would resultantly be the portion of the sleeve 18, 20 that lies above the sleeve midpoint 205.

Alternatively, the lower and upper sleeve segments 201, 203 may have different lengths. The lower sleeve segment length 202 may be greater than the upper sleeve segment length 204. Alternatively, the lower sleeve segment length 202 may be less than the upper sleeve segment length 204. The upper sleeve segment length 302 may be approximately 25 percent or greater of the total sleeve length 206. In some embodiments, the upper sleeve segment length 204 may be 33 percent or greater, 50 percent or greater, between 33 percent and 75 percent, or between 33 percent and 66 percent of the total sleeve length 206.

Similarly, each of the leg 22, 24 has a lower leg segment 211 and an upper leg segment 213. The lower leg segment 211 is a part of the leg 22, 24 distal to the body portions 14, 16 and proximate to the leg openings 96, 98. The upper leg segment 213 is a part of the leg 22, 24 proximate to the body portions 14, 16 and distal to the leg openings 96, 98. Together, the lengths 212, 214 of the lower leg segment 211 and the upper leg segment 213 account for the total length 216 of the leg. As a reference point, each leg 22, 24 has a leg midpoint 215 that is located at the point along the leg length 216, approximately equidistant from the leg opening 92, 94 and the crotch 217 of the garment 10. The crotch 217 being where each leg 22, 24 meets the body portions 14, 16 of the garment 10. The lower and upper leg segments 211, 213 may be equal in length, such that the lower leg segment 211 would be the portion of the leg 22, 24 that lies below the leg midpoint 215 and the upper leg segment 213 would resultantly be the portion of the leg 22, 24 that lies above the leg midpoint 215.

Alternatively, the lower and upper leg segments 211, 213 may have different lengths. The lower leg segment length 212 may be greater than the upper leg segment length 214. Alternatively, the lower leg segment length 212 may be less than the upper leg segment length 214. The upper leg segment length 214 may be approximately 25 percent or greater of the total leg length 216. In some embodiments, the upper leg segment length 214 may be 33 percent or greater, 50 percent or greater, between 33 percent and 75 percent, or between 33 percent and 66 percent of the total leg length 216.

Figure 5:
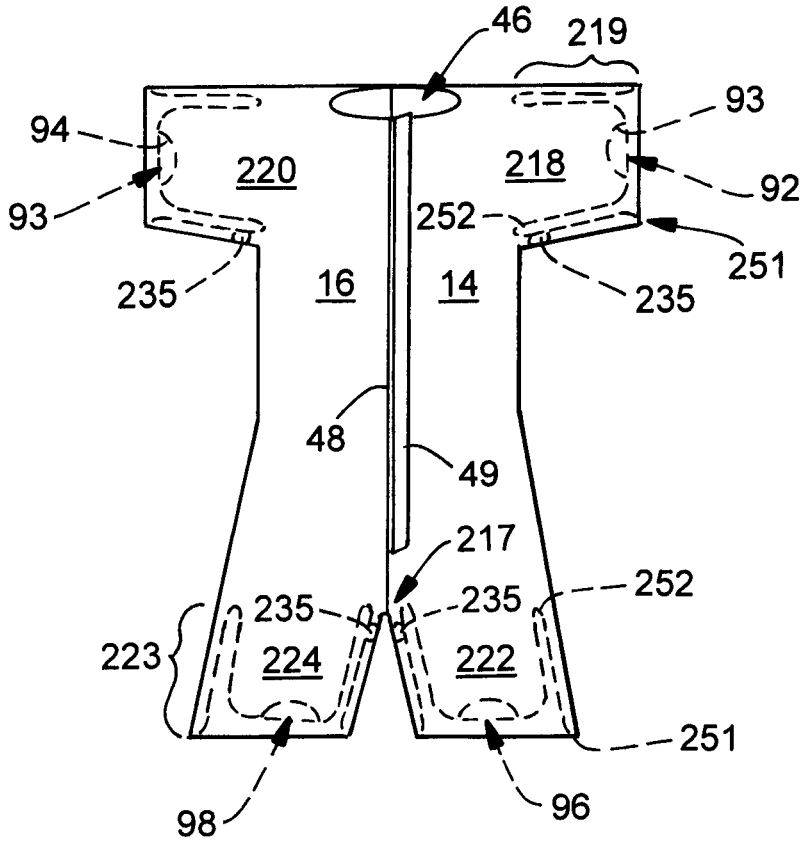
FIG. 5 illustrates a donning configuration of the protective garment of FIG. 4.

As discussed above, the donning configuration (as shown in FIG. 5) arranges the limbs of the garment 10 in a shortened configuration to ease the donning of such a garment 10. Such a donning configuration eases the donning of the garment 10 as the garment 10 holds the limbs of the garment 10 away from the floor and close to the body portions 14, 16 of the garment 10. Thus, the wearer does not have shorten and hold the limbs while they are concentrating on donning the garment 10 according to the strict donning procedures, discussed above, for such critical environments.

In the donning configuration, a lower portion of the interior surface 101 of each limb is releaseably affixed to an upper portion of the interior surface 101 of that same limb. As used herein, the term "releaseably affixed" refers to the limbs being held with enough tenacity to maintain the donning configuration during packaging, transport, removal from the packaging, shaking out of the garment 10 by the wearer, and initiation of the donning process. However, "releaseably affixed" also refers to the affixed point 235 simultaneously being weak enough such that the affixed point 235 is undone during the donning process of the garment 10; the affixed point 235 should be released without damage to the materials of the garment 10 and without the need for the wearer to manipulate the affixed point 235 more than would occur during the normal movement, or process, of physically donning the garment 10. In other words, "releaseably affixed" refers to the affixed point 235 being strong enough to hold the garment 10 in its donning configuration until the garment 10 is donned and will also readily release each limb of the garment 10 as the wearer inserts their arms and legs into the garment 10.

As shown in FIGS. 4 to 6, to place the garment 10 in the donning configuration both of the sleeves 18, 20 are shortened by releaseably affixing at least a portion of the lower sleeve segment 201 to at least a portion of the upper sleeve segment 203. Similarly, both of the legs 22, 24 are shortened by releaseably affixing at least a portion of the lower leg segment 211 to at least a portion of the upper leg segment 213.

In both the sleeves 18, 20 and legs 22, 24, it is the interior surfaces 101 of the limbs that are releaseably affixed together to form the donning configuration. This ensures that as the wearer inserts their legs and arms into the garment 10, the wearer will only contact the interior surface 101 of the garment 10 and will avoid contact with the exterior surface 103. As the wearer puts their feet into the shortened legs 222, 224, their foot will push against an interior surface 101 of the garment 10. In the embodiment illustrated in FIG. 5, the foot of the wearer would likely push against an interior surface 101 such as the inside folds 251, 252 of leg material or against the interior surface 101 near the distal leg openings 96, 98 of the shortened legs 222, 224. It may be desirable that the circumference of the leg openings 96, 98 and the ankle elastic 97 used both be designed to provide a snug fit about the ankle of the wearer and be small enough that the foot of the wearer does not prematurely exit the leg 22, 24 of the garment 10 prior to the wearer full extending their leg within the garment leg 22, 24 during donning.

Similarly, in the embodiment of FIG. 5, the hand of the wearer would likely push against an interior surface 101 such as the inside folds 251, 252 of sleeve material or against the interior surface 101 near the distal wrist openings 92, 93 of the shortened sleeves 218, 220. It may be desirable that the circumference of the wrist openings 92, 93 and the wrist elastic 93 used both be designed to provide a snug fit about the wrist of the wearer and small enough that the hand of the wearer does not prematurely exit the sleeve 18, 20 of the garment 10 prior to the wearer full extending their arm within the garment sleeve 18, 20 during donning.

In the embodiment illustrated in FIG. 5, the garment 10 is releaseably affixed in its donning configuration by a single affixed point 235 within each of the limbs. Alternatively, each of the limbs may be releaseably affixed at more than one point within the limb (see FIGS. 8A and 8B). In such multiple affixed embodiments, the sleeves 18, 20 may have the same number of releaseably affixed points as used in the legs 22, 24 or they may have a different number of releaseably affixed points. Additionally, such multiple affixed points 235 may be arranged along the length of the limb, may be positioned at various positions about the peripheral interior surface 101 (as in FIGS. 8A and 8B), or any combination of such positions and number.

Alternatively, or additionally, the garment 10 may be designed such that continuous portions (not shown) along the length of the interior surface 101 of the limbs may be releaseably affixed. Such continuous portions, may extend the entire length of the lower and upper segments 201, 211, 203, 213, or may be multiple continuous lengths along a portion of the segment lengths 202, 204, 212, 214.

The point at which the limbs are releaseably affixed in the donning configuration may be positioned to provide a desired shortened limb 218, 220, 222, 224 configuration. For example, the garment 10 illustrated in FIG. 5 utilizes a single affixed point 235 within the sleeves 18, 20 that releaseably affixes a point on the upper sleeve segment 203 close to the body portions 14, 16 to a point on the lower sleeve segment 201 that is distal from both the body portions 14, 16 and the sleeve openings 93, 94. The sleeve 18 shown in cutout view in FIG. 6 illustrates how such a donning configuration may be accomplished for the sleeve 18. A fastener 231 may be present on the interior surface 101 of the upper sleeve segment 203 slightly distal to the body portion 14 and close to the underarm 207. Such a fastener 231 may be designed to releaseably affix to a cooperative fastener 233 position on the lower sleeve segment 201. As shown in FIG. 6, the cooperative fastener 233 is more distal to the body portion 14 than the fastener 231 and is also distal from the arm opening 92. Such a positioning of a fastener 231 and cooperative fastener 233 on the upper and lower segments 201, 203 (and the resultant position of the affixed point 235) results in shortened sleeves 218, 220 as shown in FIG. 5. The shortened sleeves 218, 200 have a first fold 251 where the sleeves 18, 20 reverse within themselves, toward the interior of the garment 10 and the affixed point 235, and then reverse back toward the exterior of the garment 10 with a second fold 252. In such a donning configuration (FIG. 5), the distal sleeve openings 92, 94 are tucked within shortened arm 218, 220, while not intruding into the body portions 14, 16 of the garment 10.

In the same way, the embodiment illustrated in FIG. 5 utilizes a single affixed point 235 within the legs 22, 24 that releaseably affixes a point on the upper leg segment 213 close to the body portions 14, 16 to a point on the lower leg segment 211 that is distal from both the body portions 14, 16 and the distal leg openings 96, 98. Such a positioning of the affixed point 235 of the upper and lower segments 211, 213 results in shortened legs 222, 224 with a first fold 251 where the legs 22, 24 reverse within themselves, toward the interior of the garment 10 and the affixed point 235, and then reverse back toward the exterior of the garment 10 with a second fold 252. In such a donning configuration (FIG. 5), the leg openings 96, 98 are tucked within shortened legs 220, 224, while not intruding into the body portions 14, 16 of the garment 10.

Figures 7A, 7B, 8A, 8B:
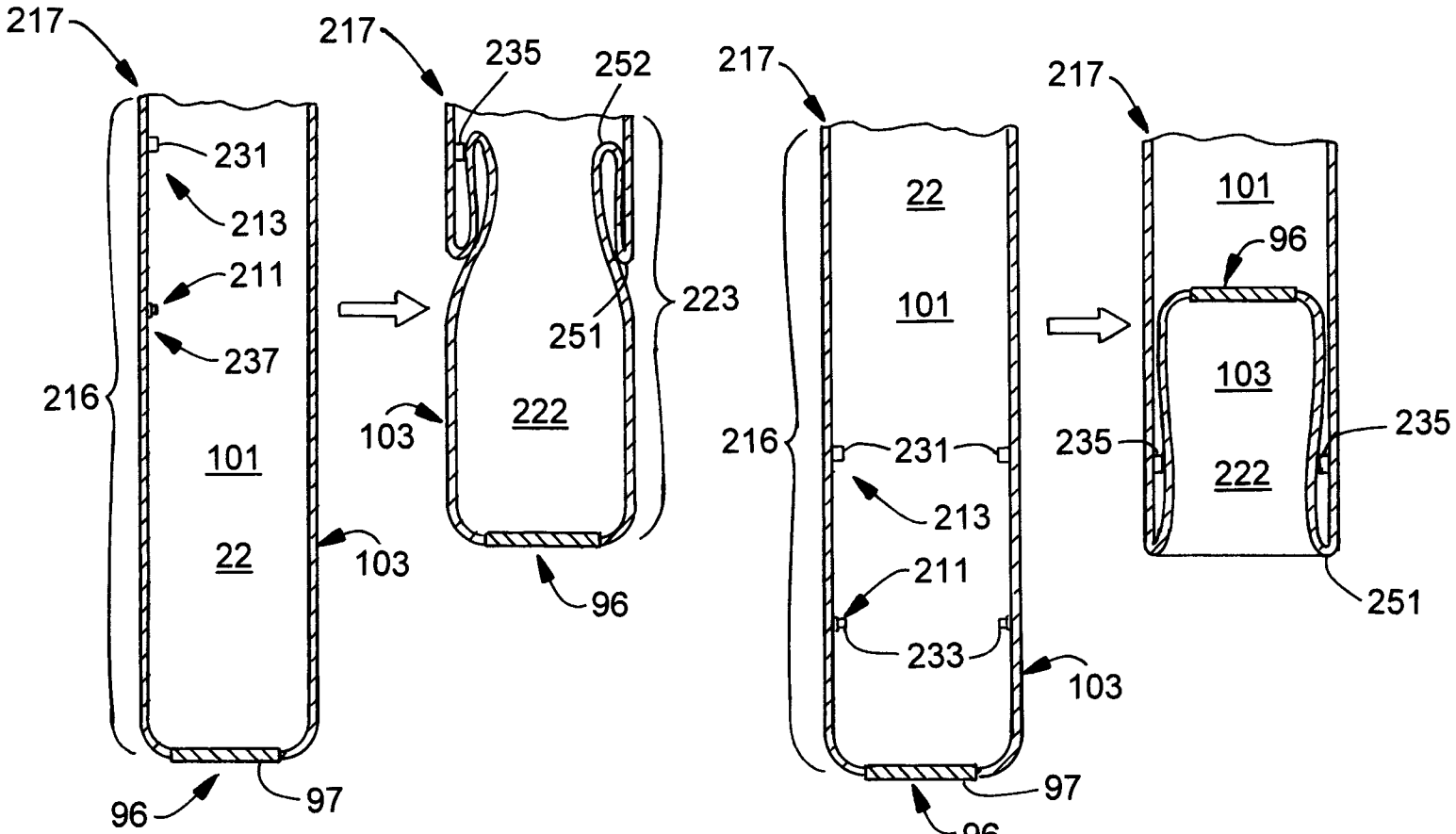
FIG. 7A is a vertical cross-sectional view illustrating a garment leg according to the present disclosure.
FIG. 7B is a vertical cross-sectional view illustrating the leg of FIG. 7A releaseably affixed in its donning configuration.
FIG. 8A is a vertical cross-sectional view illustrating a garment leg according the present disclosure.
FIG. 8B is a vertical cross-sectional view illustrating the leg of FIG. 8A releaseably affixed in its donning configuration.

Alternative placement of the affixed point(s) 235 and resultant shortened limb donning configurations are illustrated in FIGS. 7A, 7B, 8A, and 8B. Each of these figures illustrate potential configurations for a leg 22, but each could equally, or alternatively, apply to a sleeve 18, 20 of the garment 10. In FIG. 7A, the leg 22 includes a single fastener 231 on the upper leg segment 213. A point 237 on the interior surface 101 of the lower leg segment 211 is then releaseably affixed to the fastener 231 to form the shortened leg 222 illustrated in FIG. 7B. As shown in FIGS. 7A and 7B, the fastener 231 is approximately 5 to 10 percent of the leg length 216 distal from the crotch 217 while the point 237 on the lower segment 211 is approximately 30 to 50 percent of the leg length 216 distal from the crotch 217. The resultant shortened leg 222 would have a shortened leg length 223 that is approximately 60 percent of the fully extended leg length 216. Additionally, as can be seen in FIG. 7B, the resultant shortened leg 222 differs from the leg 222 in FIG. 5 in that the leg 22 is shortened, but the bulk of the lower leg segment 211 extends from the garment 10 rather than tucked in configuration illustrated in FIG. 5.

In FIG. 8A, the leg 22 includes two fasteners 231 positioned on opposing sides of the interior surface 101 of the leg 22 and two cooperative fasteners 233 further down the leg 22, also on opposing sides of the interior surface 101. The fasteners 231 are positioned on the upper leg segment 213 approximately 40 to 50 percent of the leg length 216 distal to the crotch 217 and the cooperative fasteners 233 are positioned on the lower leg segment 211 approximately 70 to 80 percent of the leg length 216 distal to the crotch 217. The donning configuration of the leg 22 is formed by releaseably affixing the fasteners 231 to the corresponding cooperative fasteners 233 to form the shortened leg 222 as illustrated in FIG. 8B. The resultant shortened leg 222 would have a shortened leg length 223 that is approximately 60 to 70 percent of the fully extended leg length 216. As seen in FIG. 8B, this alternative embodiment involves the entire lower leg segment 211 tucked back into the shortened leg 222 and extending toward the body of the garment 10. Alternatively, a second fold 252 could be included to reverse the tucked in portion, such as utilized in the embodiment illustrated in FIG. 5.

One skilled in the art would recognize that different combinations of placement of one or more affixed points 235 may be utilized to provide the desired donning configuration. Various configurations of one or more affixed points 235 may be utilized to provide shortened sleeves 218, 220, shortened legs 222, 224, or both that are any shortened length 219, 223 that is desired. Preferably, the shortened sleeve length 219 will be approximately equal to or less than two-thirds of the full sleeve length 206 and the shortened leg length 223 will be approximately equal to or less than two-thirds the full leg length 216. The shortened sleeve lengths 219 may be approximately equal to or less than 50 percent of the full sleeve length 206 and the shortened leg length 223 may be approximately equal to or less than 50 percent of the full leg length 216.

One skilled in the art would also recognize that the number of internal folds within the shortened limb and the orientation of those folds may be configured as desired. As discussed above, it may be desirable that the shortened limb is not allowed to intrude into the body portions 14, 16 when in the donning configuration. Also, as previously discussed, it may be desired to present more folds 251, 252 of materials to the shortened limbs in the donning configuration such that the hand or foot of the wearer is more likely to push against such folds 251, 252 when donning the garment 10 and thus prevent the wearer from prematurely pushing their hand or foot through the garment openings 92, 94, 96, 98.

Again, the interior surfaces 101 of the limbs of the garment 10 are releaseably affixed in a shortened configuration to form the donning configuration of the garment 10. In the donning configuration at least a portion of the lower segment of each limb is releaseably affixed to at least a portion of the upper segment of that same limb. As discussed above, the limb is releaseably affixed in such a way that the garment 10 is held in its donning configuration during packaging, shipping, unpacking, unfolding, shaking by the wearer, and other handling that may occur up until the garment 10 is donned. When the garment 10 is donned, the affixed point 235 should then release the lower segment from the upper segment of the garment limb as the wearer inserts their leg or arm into the garment limb during the donning of the garment 10. The donning configuration of the garment 10 is released as the garment 10 is donned without the wearer having manipulate the garment 10 to any greater degree than occurs by insertion of their legs and arms into the garment 10. Additionally, the affixed point 235 should release the garment 10 from its donning configuration without damaging the garment 10.

The sleeve 18 illustrated in FIG. 6 shows one potential method of releaseably affixing the garment 10 in a donning configuration. As seen in FIGS. 6, 8A and 8B, one or more fasteners 231 may be used with one or more cooperative fasteners 233. Such a fastener 231 and cooperative fastener 233 may be positioned directly on the interior surface 101 of the particular sleeve 18, 20 or leg 22, 24. The fasteners 231 may alternatively be positioned on a seam 241 within the garment limb, such as shown in FIG. 6. In the particular sleeve 18 illustrated in FIG. 6, a seam 241 runs along the underside of the arm 18. Such positioning upon the seam 241 may prevent damage to the integrity of the garment 10 that might otherwise result due to the attachment of the fastener 231 or cooperative fastener 233 directly to the interior surface 101 or that might result as the garment 10 is released from its donning configuration during donning.

One typical fastener 231 and cooperative fastener 233 combination, as shown in FIGS. 6 and 8A, is a snap. Other potential fastener and cooperative fastener combinations may include cohesives, hook and loop cooperative fasteners, magnets, slot and tabs, and other such similar combination of a fastener 231 and a cooperative fastener 233 that releaseably affixes to such a fastener 231.

Alternatively, the garment 10 may be releaseably affixed with the use of a lone fastener 231 that releaseably affixes the upper segment to the lower segment of the interior surface 101 of the particular limb. An example of such a garment 10 utilizing a lone fastener 231 is shown in FIGS. 7A and 7B. Such a fastener 231 may include an adhesive (pressure-sensitive or other variety), adhesive tapes, a hook material that directly engages the interior surface 101, or other such similar fasteners 231. Another possible fastener 231 may be a single stitch or knot that releaseably affixes the upper portion to the lower portion of a particular limb. For example, for a sleeve 18 such as illustrated in FIG. 6, rather than utilizing the fastener 231 and cooperative fastener 233 that are shown, those same two points along the seam 241 may be affixed by a single, simple stitch of thread or a simple slip knot. Then, as the garment 10 is donned, the stitch or knot would come undone, or break, thus releasing the sleeve 18 from its donning configuration.

Such fasteners 231 and cooperative fasteners 233, if present, should be made of a material, and be of a type, that is compatible for the material of the garment 10, compatible with the sterilization technique utilized (if sterilization used), and appropriate for the environment in which the garment 10 is used. One skilled in the art would understand that any combination of types of fasteners 231 and cooperative fasteners 233, number of such fasteners 231, and position of such fasteners 231 may be utilized to address the particular garment 10 design and garment use that may be desired.

Such a garment 10 may be packaged by any means and/or method that allows for the wearer to easily access the garment 10 for donning, while ensuring that the wearer does not touch an exterior surface 103 of the garment 10. One exemplary method of preparing the garment 10 for donning may include the first step of shortening the sleeves 18, 20 and legs 22, 24 of the garment 10. As discussed above for the garment 10 illustrated in FIGS. 4 and 5, the manufacturer would releaseably affix the interior surfaces 101 of the lower segments to the upper segments of each of the limbs. A garment 10 in such a resultant donning configuration is illustrated in FIG. 5, which shows the shortened sleeves 218, 220 and shortened legs 222, 224.

Next, with the front side 12 of the garment 10 laying against a table, the shortened sleeves 218, 220 may then be folded toward the back side 13 of the garment. Similarly, the shortened legs 222, 224 may then be folded up toward the back side 13 of the garment 10, on top of the folded shortened sleeves 218, 220. Finally, the partially folded garment 10 may be flipped over such that the closure means 48 is facing upwards. The closure means 48 may be opened and the left and right opening flaps 50, 52 may be pulled open and around to the back 13 of the partially folded garment 10 such that only the interior surface 101 of the garment 10 is exposed on the outside of the folded garment.

This method of folding of the garment 10 is only one potential method of folding the garment 10. Other methods that shortened the sleeves 218, 220 and the legs 222, 224 and fold the garment 10 such that the interior surface 101 is made available to the wearer during subsequent unfolding and donning are also contemplated. One skilled in the art would see how a different order of folding steps, numbers of folds, desired final folded dimensions, and other such considerations, may contribute to different methods of folding up the garment 10.

Additionally, such garments 10 are typically laundered and dried to remove any excessive particulates that may be present from the garment manufacturing process. This step would likely need to occur before the folding steps.

Once folded, the garment 10 may be packaged in any method as known to package such garments 10 to form a protective garment package to be delivered to the wearer. Typically, the folded garment 10 may be placed in a bag and the bag sealed to form a garment package. It may be desired that the garment package be sterilized by any sterilization as is known for such products. Additionally, it may be desirable that the air within the bag be removed during packaging, such that the garment is vacuum-packed, prior to such sterilization.

The garment 10 may be configured such that the wearer of the garment may easily don the garment 10 without touching an exterior surface 103 of the garment and without letting any portion of the garment touch the floor. The wearer first grasps the interior surface 101 of the folded garment in such a way as to allow gravity to unfold the garment 10 into the donning configuration, such as illustrated in FIG. 5. Often the wearer, while solidly grasping the interior surface 101 with both hands, may give the garment 10 a quick snapping motion to unfold the garment. As discussed above, the garment 10 is releaseably affixed in the donning configuration with enough force so that such a snapping motion will help unfold the garment 10, but will not cause the garment 10 to prematurely release from its donning configuration.

The wearer then inserts one of their feet into the appropriate leg (22 or 24) of the garment 10, making sure that the foot presses against the interior folds and/or the gathered opening 96, 98 of the shortened leg 222, 224. As the wearer continues to extend their leg, pressing their foot against the interior folds and/or gathered opening, the lower segment 211 of the leg 22, 24 is released from its upper segment 213. The wearer then extends their foot through the leg opening 96, 98 and engages the donning loop 36, if present. This is then repeated for the wearer's other leg. As the wearer pulls up on the body portions 14, 16 of the garment 10, the shortened legs 222, 224 of the garment 10 will lengthen to length of the wearer's legs and provide the wearer with the appropriate leg fit.

Next, the wearer inserts one of their arms into the appropriate sleeve (18 or 20) of the garment 10, making sure that the hand presses against the interior folds and/or the gathered opening 92, 94 of the shortened arm 218, 220. As the wearer continues to extend their arm, pressing their hand against the interior folds and/or gathered opening 92, 94, the lower segment 201 of the arm is released from its upper segment 203. The wearer then extends their hand through the hand opening 92, 94 and engages the donning loop 36, if present. This is then repeated for the wearer's other arm. As the wearer extends their arms into the sleeves 18, 20 and pulls the garment shoulders 62 over their own shoulders, the shortened sleeves 218, 220 will lengthen to the length of the wearer's arms and provide the wearer with the appropriate arm fit. The wearer then completes the donning of the garment 10 by closing the closing means 48 and securing the closure flap 49 over the closing means 48.

The garment 10 may also include other additional features. In FIG. 1, the garment 10 includes a neck opening 46 along the shoulder 62 of the garment 10. An additional feature for such garment 10 may be the addition a collar and/or hood fitted to such a neck opening 46. In some embodiments, such as illustrated in FIG. 3, the garment 10 may include elasticized bands 17 to provide a snugger fit to various portions of the garment 10. As shown in FIGS. 4 and 6, another feature may be elastic wrist cuffs 93 added to the wrist openings 92, 94 of the garment 10 to ensure that such openings fit snugly against a wearer. Additionally, or alternatively, elastic ankle cuffs 97 may be present with the ankle openings 96, 98 or wrist openings 92, 94. Piping may be added to the garment 10, to allow for attachment of badges to the garment without breaching the integrity of the garment material. Such piping may additionally, or alternatively, be included for aesthetic purposes. Other features such as pockets are also considered. The garment 10 may additionally include re-sealable openings to allow a wearer to access the interior of the garment 10 without having to remove the garment 10.

The closure means 48 of the garment 10 may include any type of fastener as are common for such protective garments. Desirably, the closure means 48 will be a mechanical closure device, such as a standard zipper for barrier protection. However, it is contemplated that other fasteners such as hook-and-loop fasteners, snaps, re-sealable tapes, or other similar fasteners may be used, depending on the level of protection required of the garment 10. Additionally, as illustrated in FIGS. 4 and 5, the closure means 48 of the garment 10 may include a closure flap 49 that covers the closure means 48. The flap 49 may be secured by a variety of fasteners.

The garment 10 may alternatively incorporate an obliquely oriented opening with an associated fastener, across the front torso region of the garment, instead of a conventional vertical opening for entry into the garment. For example, a zipper may start at the shoulder and proceed diagonally across the torso down to the upper thigh region. This allows the torso of the garment to be opened wide. An angled zipper that starts away from the neck of the wearer may be less irritating.

Colors, symbols, words, logos, or other such indicia may be employed to communicate a particular message, such as the relative level of protection, or to provide distinctive appearance as a style element. Colors may be applied to the material of the entire garment 10, individual portions of the garment 10, or as fabric piping along seams, around pockets or leggings, or in distinctive patterns. A logo denoting branding or level of protection may be located on the garment 10. Color may be added to the closure means for communication and appearance purposes.

Such indicia may be utilized in the garment 10 to help the wearer identify the interior surface 101 of the garment 10, or particular area of the interior surface 101, where the wearer should grasp the garment 10 while donning the garment 10. For example, the material that is used to make the garment 10 may be of different color, or color shade, on one side versus the other side of the material. Garments made of such a material would then have a different color, or shade, on the interior surfaces of the garment versus the exterior surfaces 103. Alternatively, or additionally, a symbol or a word may be printed on the interior surface 101 of the garment 10 indicating the optimal place for the wearer to grasp the garment 10 for easy donning.

Generally speaking, the manufacture of such garments may be in accordance with known automated, semi-automated, or hand assembly procedures. For example, attachment of the various portions of the garment may be achieved utilizing sewing or stitching, ultrasonic bonding, solvent welding, adhesives, thermal bonding and similar techniques.

All materials used in the protective garment 10 have barrier properties that meet industrial standards for their respective designated level of protection. The garment materials are generally breathable and liquid resistant barrier materials. The breathability of the material increases the comfort of someone wearing such a garment, especially if the garment is worn under high heat index conditions, vigorous physical activity, or long periods of time. Various suitable woven and non-woven barrier materials are known and used in the art for garments such as surgical gowns, coveralls, industrial protective garments, and the like. All such materials are within the scope of the present disclosure.

The material used to form the garment may be one or more bonded carded webs, webs of spunbonded fibers, webs of meltblown fibers, webs of spunlaced fibers, webs of other nonwoven materials, one or more knit or woven materials, one or more films, and combinations thereof. The material may be formed from polymers such as, for example, polyamides, polyolefins, polyesters, polyvinyl alcohols, polyurethanes, polyvinyl chlorides, polyfluorocarbons, polystyrenes, caprolactams, copolymers of ethylene and at least one vinyl monomer, copolymers of ethylene and n-butyl acrylate, and cellulosic and acrylic resins, and mixtures and blends of the same. If the material is formed from a polyolefin, the polyolefin may be polyethylene, polypropylene, polybutene, ethylene copolymers, propylene copolymers and butene copolymers.

Multiple layers of seamless sheet material may be joined into a seamless laminate and used to form garments having desirable barrier properties. Laminates can be formed by combining layers of seamless sheet materials with each other and/or forming or depositing layers of such materials on each other. For example, the material may be a laminate of two or more nonwoven webs. As a further example, the material may be a laminate of at least one web of spunbonded fibers and at least one web of meltblown fibers and mixtures thereof.

For example, useful multi-layer materials may be made by joining at least one web of meltblown fibers (which may include meltblown microfibers) with at least one spunbonded continuous filament web. An exemplary multi-layer seamless material useful for making the protective garment of the present invention is a nonwoven laminated fabric constructed by bonding together layers of spunbonded continuous filaments webs and webs of meltblown fibers (which may include meltblown microfibers) and may also include a bonded carded web or other nonwoven fabric.

An exemplary three-layer fabric having a first outer ply of a spunbonded web, a middle ply of a meltblown web, and a second outer ply of a spunbonded web may be referred to in shorthand notation as SMS. Such fabrics are described in detail in U.S. Pat. Nos. 4,041,203, 4,374,888, and 4,753,843, all of which patents are assigned to the Kimberly-Clark Corporation, the assignee of the present invention.

An exemplary material which could be used for the manufacture of protective garment 10 is laminated fabric constructed by bonding together at least one layer of a nonwoven web with at least one layer of a film. Generally speaking, the film layer may range in thickness from about 0.25 mil to about 5.0 mil. For example, the film will have a thickness ranging from about 0.5 mil to about 3.0 mil. Desirably, the film will have a thickness ranging from about 1.0 mil to about 2.5 mil.

Exemplary film layers include films formed from polymers which may include polyamides, polyolefins, polyesters, polyvinyl alcohols, polyurethanes, polyvinyl chlorides, polyfluorocarbons, polystyrenes, caprolactams, copolymers of ethylene and at least one vinyl monomer, copolymers of ethylene and n-butyl acrylate, and cellulosic and acrylic resins. If the film layer is made of a polyolefin, the polyolefin may be polyethylene, polypropylene, polybutene, ethylene copolymers, propylene copolymers and butene copolymers and blends of the above.

The seamless sheet material of the garment 10 may have a basis weight ranging from about 15 gsm (i.e., grams per square meter) to about 300 gsm. For example, the seamless sheet material may have a basis weight ranging from about 20 gsm to about 100 gsm. Desirably, the material may have a basis weight ranging from about 20 gsm to about 75 gsm.

For example, the material may be made from various forms of calendared nonwoven materials, such as Dupont Tyvek® brand high-density polyethylene materials. Garments made of Tyvek® have been used for hazardous environments or for general, non-hazardous, industrial use. Examples of uses for hazardous environments include protection against water-based acids, bases, salts and splashes of certain liquids, such as pesticides and herbicides. The garments also provide a reliable barrier against exposure to harmful dry particles, such as lead dust, asbestos and particles contaminated with radiation. Non-hazardous, industrial uses include wearing the garments for "dirty jobs" at factories, workshops, engineering plants, farms and construction sites.

The resistance hydrostatic pressure (hydrohead) of the protective articles will depend, in part, on the particular kind of material from which the article is constructed. The garment may be designed to have a liquid hydrohead resistance of at least about 15, 17 or 20 millibars, up to about 180, 187, or 200 millibars, inclusive of all range combinations thereinbetween. More commonly, the garment may have a hydrohead resistance of about 25 or 30 to about 115 millibars, preferably between about 45 to about 110 millibars, and more preferably between about 50 millibars to about 95 millibars of pressure.

The air permeability of the garment materials, may range from at least about 2 cubic feet per meter (cfm) up to about 47 or 50 cfm, inclusive of all range combinations thereinbetween. More typically, the air permeability may be in the range from about 5 or 10 cfm to about 43 or 45 cfm, and preferably between about 15, 17, 20, or 25 cfm to about 40 or 42 cfm.

The garment may have a moisture vapor transmission rate (MVTR) of up to about 4700 $g/m^2/24$ hours, more typically about between about 2700 or 3600 MVTR to about 4500 or 4600 MVTR. The protective garment may protect the wearer resistance of about 9-100% against dry particle barrier intrusion of a particle size of 0.3-05 microns.

The garment may be made from a material that provides a barrier to dust and microparticulates (e.g., ranging in size from about 0.05-0.10 microns or larger (see, e.g., U.S. Pat. No. 5,491,753) or light-splash fluids. The materials of the garment may also be electret-treated to generate a localized electrostatic charge within the fibers of the nonwoven web (e.g., U.S. Pat. No. 5,401,446 to Tsai). For example, these materials may be treated with compositions such as Zepel® and Zelec®, available from E. I. du Pont De Nemours, located in Wilmington, Del.

The present invention has been described in general and in detail by way of examples. Persons of skill in the art understand that the invention is not limited to the specific embodiments disclosed. Modification and variations of the general concept may be made without departing from the scope of the invention as defined by the following claims or equivalents, including, equivalent components.

We claim:

1. A protective garment comprising:

an interior surface;

an exterior surface;

a body portion;

a right leg and a left leg, where both legs extend from the body portion; and a right sleeve and a left sleeve, where both sleeves extend from the body portion;

where each leg is constructed of a seamless sheet of material that forms a single seam along the leg, each leg comprising an interior surface, an exterior surface, an opening distal to the body portion, an upper segment proximate the body portion, a lower segment distal to the body portion, and an extended total leg length measured from the body portion to the distal opening, where each sleeve is constructed of a seamless sheet of material that forms a single seam along an underside of the sleeve, each sleeve comprising an interior surface, an exterior surface, an opening distal to the body portion, an upper segment proximate the body portion, a lower segment distal to the body portion, and an extended total sleeve length measured from the body portion to the distal opening, and at least one sleeve fastener limited to the interior surface of each sleeve between the body portion and a point 50 percent of the sleeve length distal from the body portion that releasably affixes the interior surface of at least a portion of the upper segment of each sleeve to the interior surface at least a portion of the lower segment of each sleeve;

at least one leg fastener limited to the interior surface of each leg between the body portion and a point 50 percent of the extended total leg length distal from the body portion that releasably affixes the interior surface of at least a portion of the upper segment of each leg to at least a portion of the lower segment of each leg; and wherein, when the upper segment is coupled to the lower segment of each sleeve by the sleeve's respective sleeve fastener and when the upper segment is coupled to the lower segment of each leg by the leg's respective leg fastener, the garment comprises a donning configuration, the donning configuration comprising at least one fold releasably affixed to the interior surface of the seamless sheet of material of the legs and sleeves, respectively, and wherein, when the upper segment and lower segment of each sleeve and each leg are uncoupled, the sleeves and legs assume a total extended sleeve length and a total extended leg length, where the upper segments and the lower segments of each sleeve and leg are no longer coupled together along the interior surface.

2. The garment of claim 1, where each leg further comprises a cooperative leg fastener positioned on the interior surface of the leg between the distal opening and a point 50 percent of the total extended leg length, where each sleeve further comprises a cooperative sleeve fastener positioned on the interior surface of the sleeve between the distal opening and a point 50 percent of the total extended sleeve length, and wherein in the donning configuration, each leg fastener of each leg is releaseably affixed to the cooperative leg fastener positioned within each leg and each sleeve fastener of each sleeve is releaseably affixed to the cooperative sleeve fastener positioned within each sleeve.

3. The garment of claim 2, where each cooperative leg fastener is positioned on the interior surface of the leg between a point 80 percent of the total extended leg length and a point 50 percent of the total extended leg length, and where each cooperative sleeve fastener is positioned on the interior surface of the sleeve between a point 80 percent of the total extended sleeve length and a point 50 percent of the extended total extended sleeve.

4. The garment of claim 3, where each leg fastener is limited to the interior surface of the leg between a point 5 percent of the total extended leg length and a point 30 percent of the total extended leg length, and where each sleeve fastener is limited to the interior surface of the sleeve between a point 5 percent of the total extended sleeve length and a point 30 percent of the total extended sleeve length.

5. A protective garment as defined in claim 1, further comprising a donning loop associated with the openings of each sleeve.

6. A protective garment as defined in claim 1, wherein the garment is made from a material comprising a nonwoven material.

7. A protective garment as defined in claim 1, wherein the garment is made from a material comprising a bonded carded web, a web of spunbonded fibers, a web of meltblown fibers, a web of spunlaced fibers, or combinations thereof.

8. A protective garment as defined in claim 1, wherein the garment is made from a laminate material comprising a laminate of two or more nonwoven webs.

9. A protective garment as defined in claim 1, wherein the garment is made from a three-layer fabric comprising an outer ply of a spunbonded web, a middle ply of a meltblown web, and a second outer ply of a spunbonded web.

10. A protective garment as defined in claim 1, wherein the garment is made from a material having a basis weight of from about 20 gsm to about 75 gsm.

11. A protective garment as defined in claim 1, wherein the garment is made from a laminated fabric comprising at least one layer of a nonwoven web and at least one layer of a film.

* * * * *